US006765690B1

(12) United States Patent
Matsumoto et al.

(10) Patent No.: US 6,765,690 B1
(45) Date of Patent: Jul. 20, 2004

(54) TEXTILE PRINTING SYSTEM, AND PLATE SEPARATION APPARATUS AND METHOD

(75) Inventors: Hisashi Matsumoto, Yokohama (JP); Hiroshi Endo, Yokohama (JP); Eiichi Takagi, Yokohama (JP); Takeshi Ozasa, Yokohama (JP); Akio Iino, Inagi (JP); Takahisa Akaishi, Machida (JP); Yoshikazu Ishikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 849 days.

(21) Appl. No.: 09/604,742

(22) Filed: Jun. 28, 2000

(30) Foreign Application Priority Data

Jul. 1, 1999 (JP) ..... 11-188125
Jul. 1, 1999 (JP) ..... 11-188126

(51) Int. Cl.[7] ..... B41B 1/00

(52) U.S. Cl. ..... 358/1.2; 358/1.2; 358/2.1; 358/523; 358/501

(58) Field of Search ..... 358/1.2, 2.1, 502, 358/523; 101/115, 126, 477, 478; 8/445; 347/71

(56) References Cited

U.S. PATENT DOCUMENTS

| | | | | |
|---|---|---|---|---|
| 4,423,676 A | | 1/1984 | Neel | 101/211 |
| 4,841,306 A | | 6/1989 | Archer et al. | 347/4 |
| 5,160,505 A | * | 11/1992 | Seveno et al. | 8/471 |
| 5,375,516 A | * | 12/1994 | Hasegawa | 101/116 |

(List continued on next page.)

FOREIGN PATENT DOCUMENTS

| | | |
|---|---|---|
| DE | 195 33 811 | 3/1997 |
| EP | 0 646 460 | 4/1995 |
| EP | 0 792 059 | 8/1997 |
| EP | 0 836 939 | 4/1998 |
| EP | 0 878 303 | 11/1998 |
| NL | 9201679 | 4/1994 |

*Primary Examiner*—Edward Coles
*Assistant Examiner*—Zebene Sanbet
(74) *Attorney, Agent, or Firm*—Fitzpatrick, Cella, Harper & Scinto

(57) ABSTRACT

This invention allows both a plateless textile printer that makes process color expression, and a plate textile printer to achieve equivalent color expressions. For this purpose, image data that uses an RGB pallet is converted into YMCK image data using a correction table. An ink-jet textile printer (14) prints on textile on the basis of the converted image data. On the other hand, the image data that uses the RGB pallet is sent to a plate separation data generation unit (15), and is separated into binary plate data, the number of which is the same as the number of ink colors of the ink-jet textile printer, using an RGB/ink color tone correction table to realize the same color expression as that of screen textile printing. In this case, a plate data file name to be generated, the resolution of a plate to be output, the number of repetitions of an original design of plate data to be output in the horizontal direction, and the number of repetitions of the original design of the plate data to be output in the vertical direction are respectively input to boxes (61, 66, 71, 72) on a dialog. Also, an input conversion file, an output conversion file, a tone curve file used by retouch software, an original image resolution, an enlargement/reduction method, an ink table file, an output data type, and a repetition method are respectively selected using pull-down menus (62, 63, 64, 65, 67, 68, 69, 70) of the dialog. Using these parameters, a film plotter (18) prints images in units of plates (colors) on lith films, and the printed lith films are set in an exposure machine (19) to undergo exposure, thus obtaining all plates. Using the obtained plates, a screen textile printer (20) prints on textile using the same inks as those of the ink-jet textile printer.

25 Claims, 14 Drawing Sheets

U.S. PATENT DOCUMENTS 5,528,377 A * 6/1996 Hutcheson ..... 358/1.9
5,588,770 A * 12/1996 Bart ..... 403/325
5,673,621 A * 10/1997 Vaughan ..... 101/126
5,847,729 A 12/1998 Takahashi et al. ..... 347/43
5,974,964 A * 11/1999 Adams ..... 101/129
5,980,020 A 11/1999 Miura et al. ..... 347/41
5,992,963 A * 11/1999 Miyake et al. ..... 347/18
6,024,431 A 2/2000 Takahashi et al. ..... 347/19
6,031,974 A 2/2000 Takahashi et al. ..... 358/1.9
6,116,728 A 9/2000 Miyake et al. ..... 347/102
6,214,963 B1 * 4/2001 Noguchi et al. ..... 528/71
6,220,687 B1 * 4/2001 Takahashi et al. ..... 347/5
6,328,434 B1 * 12/2001 Soneda et al. ..... 347/68
6,472,051 B2 * 10/2002 Hirabayashi et al. .... 428/32.16
6,513,924 B1 * 2/2003 Goldberg et al. ..... 347/106

* cited by examiner

HALF-STEP ORIGINAL IMAGE

HALF-STEP IMAGE AFTER PLATE SEPARATION

TEXTILE PRINTING SYSTEM, AND PLATE SEPARATION APPARATUS AND METHOD

FIELD OF THE INVENTION

The present invention relates to a textile printing system, and a plate separation apparatus and method.

BACKGROUND OF THE INVENTION

Conventionally, textile printing using plates (to be referred to as plate textile printing hereinafter), and textile printing such as ink-jet textile printing expressed by process colors without using any plates (to be referred to as plateless textile printing hereinafter) are known.

In order to achieve identical color reproduction of prints obtained by such textile printing processes, conventionally, an ink-jet textile printer outputs color patches generated based on RGB or CMYK digital data, and an operator visually selects a patch which is similar to the color of a print obtained by plate textile printing. Based on the selected patch color, the operator retouches original data of the print. That is, the colors of plateless textile printing are adjusted to those of plate textile printing. This in part results from the fact that plate textile printing uses only spot color expression.

However, such processes are difficult unless the operator is skilled. On the other hand, when a plateless textile printing system is used as a sample forming machine, and a plate textile printing system is used as an actual production machine, a print with excellent grayscale reproduction that is obtainable by process colors often cannot be obtained by plate textile printing using spot color expression. Especially, it is difficult for plate textile printing to express a CG or photo-like illustration. Hence, it is hard to match color expressions of these textile printing systems, and color expression of a print obtained by a plate textile printing system has never been adjusted to that of a print output in process color expression by a plateless textile printing system.

Therefore, there is no plate separation method in which process color expression is realized by plate textile printing in correspondence with that of a print output from a plateless textile printer.

SUMMARY OF THE INVENTION

The present invention has been made to solve the conventional problems, and has as its object to provide a textile printing system which allows a plateless textile printer using process color expression and a plate textile printer to achieve equivalent color expression, and a plate separation apparatus and method.

A textile printing system comprises:

a first textile printer that makes process color expression;

plate separation means for performing a plate separation process for original image data; and a second textile printer for performing textile printing using plates based on plate data output from the plate separation means, wherein the plate separation means comprises:

input means for inputting a file name and resolution of plate data to be output, and the number of repetitions of original image data; and selection means for selecting a conversion table file, a tone curve file, a resolution of original image data, a conversion ink table file, a resolution conversion method, the number of plate data, and a type of repetition of the original image data, and the plate separation means performs plate separation on the basis of the inputs from the input means and the selections at the selection means.

Note that the selection means selects the conversion ink table file for each ink color.

Also, the number of ink colors of the first textile printer is eight, and the number of plates of the second textile printer is eight.

The plate separation means separates the image data into plates, the number of which is larger by one than the number of ink colors of the first textile printer.

A gray plate is generated in addition to plates corresponding to ink colors.

A textile printing system comprises:

a first textile printer which makes process color expression without using any plates;

plate separation means for performing a plate separation process for original image data; and a second textile printer for performing textile printing using plates based on plate data output from the plate separation means, wherein the plate separation means comprises:

input means for inputting a type of repetition of the original image data and a number of times of repetition; and plate data generation means for generating plate data from the original image data on the basis of the inputs from the input means.

The input means can select one of four-way feed and half pitch as the type of repetition.

The second textile printer is a printer which uses one of a hand textile printing scheme, screen textile printing scheme, roll textile printing scheme, and rotary textile printing scheme.

A plate separation apparatus according to the present invention is a plate separation apparatus which receives image data which is the same as image data input to a first textile printer that makes process color expression without using any plates, generates plate data corresponding to ink colors used in the first textile printer, and outputs the plate data to a second textile printer that performs textile printing using plates, comprising:

input means for inputting a type of repetition of original image data and a number of times of repetition; and plate data generation means for generating plate data from the original image data on the basis of the inputs from the input means.

A plate separation method according to the present invention is a plate separation method which receives image data which is the same as image data input to a first textile printer that makes process color expression without using any plates, generates plate data corresponding to ink colors used in the first textile printer, and outputs the plate data to a second textile printer that performs textile printing using plates, comprising:

the input step of inputting a type of repetition of original image data and a number of times of repetition; and the plate data generation step of generating plate data from the original image data on the basis of the inputs in the input step.

A computer readable memory according to the present invention is a computer readable memory storing a plate separation program, which receives image data which is the same as image data input to a first textile printer that makes process color expression without using any plates, generates plate data corresponding to ink colors used in the first textile printer, and outputs the plate data to a second textile printer that performs textile printing using plates, the plate separation program including:

an input program for inputting a type of repetition of original image data and a number of times of repetition; and a plate data generation program for generating plate data from the original image data on the basis of the inputs in the input program.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

A preferred embodiment of the present invention will be explained in detail hereinafter with reference to the accompanying drawings. Note that the relative layout of building components, numerical values, and the like described in this embodiment do not limit the scope of the present invention to themselves unless otherwise specified.

A technique anticipated by the present invention will be explained first.

(Anticipated Technique)

Figure 13:
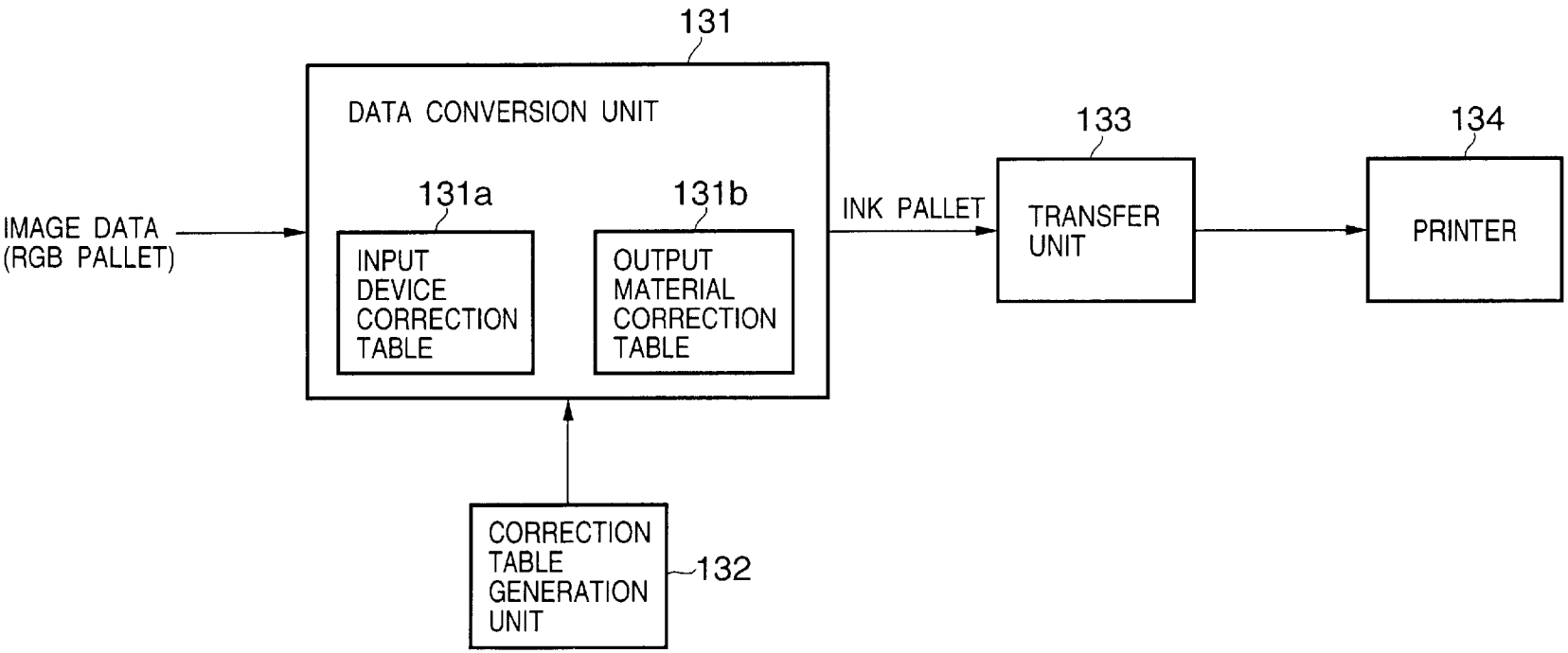
FIG. 13 is a diagram showing the flow of the processes of an ink-jet textile printing system as a presupposed technique.

FIG. 13 shows data flow in an ink-jet textile printing system through a print process.

To perform ink-jet textile printing, a data conversion unit 131 converts image data input using an RGB pallet. Data conversion is done on the basis of a correction table generated by a correction table generation unit 132. A correction table 131*a* which corresponds to different input devices (e.g., an image scanned by a scanner, or a CG) and a correction table 131*b* which corresponds to different output materials are prepared.

A transfer unit 133 transfers image data, which has been converted into respective color data of an ink pallet (CMYK system) prepared in a textile printing machine via the data conversion unit 131, to an ink-jet textile printer 134.

Figure 14:
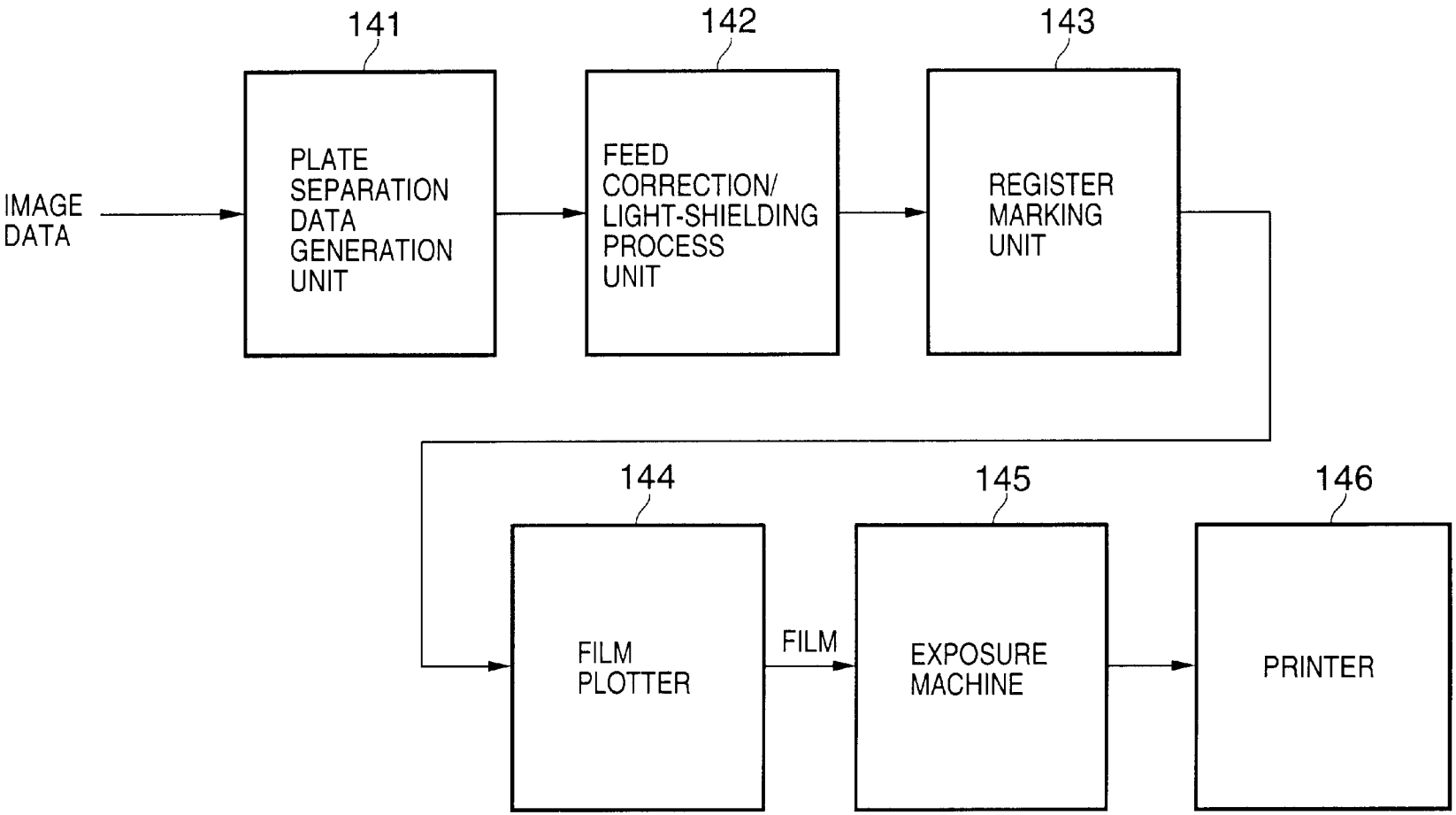
FIG. 14 is a diagram showing the flow of the processes of a screen textile printing system as a presupposed technique.

FIG. 14 shows processes in a screen textile printing system through a print process.

In screen textile printing, input image data is input to a plate separation data generation unit 141, which reduces the number of colors of the input image data to be equal to the number of plates used and converts the image data into binary image data in units of plates (colors). The color binary image data are processed by a feed correction/light-shielding process unit 142 in units of plate (color) data, and are provided with register marks by a register marking unit 143. A film plotter 144 prints image data in units of plates (colors) on lith films. The printed lith films are set in an exposure machine 145 and undergo exposure to obtain all plates. A screen textile printer 146 prints on textile using the obtained plates.

The ink-jet textile printing system and screen textile printing system receive different image data. This must be retouched in advance in correspondence with the textile printing method and must undergo resolution conversion. Also, these systems are not linked, and require fine adjustment by a skilled person in order to adjust color expressions of output prints.

(One Embodiment)

The first embodiment of the present invention will be described below using FIGS. 1 to 12.

This embodiment is directed to a technique for allowing both an ink-jet textile printer and a screen textile printer to easily achieve color expressions at an equivalent level on the basis of identical image data.

[System Arrangement]

Figure 1:
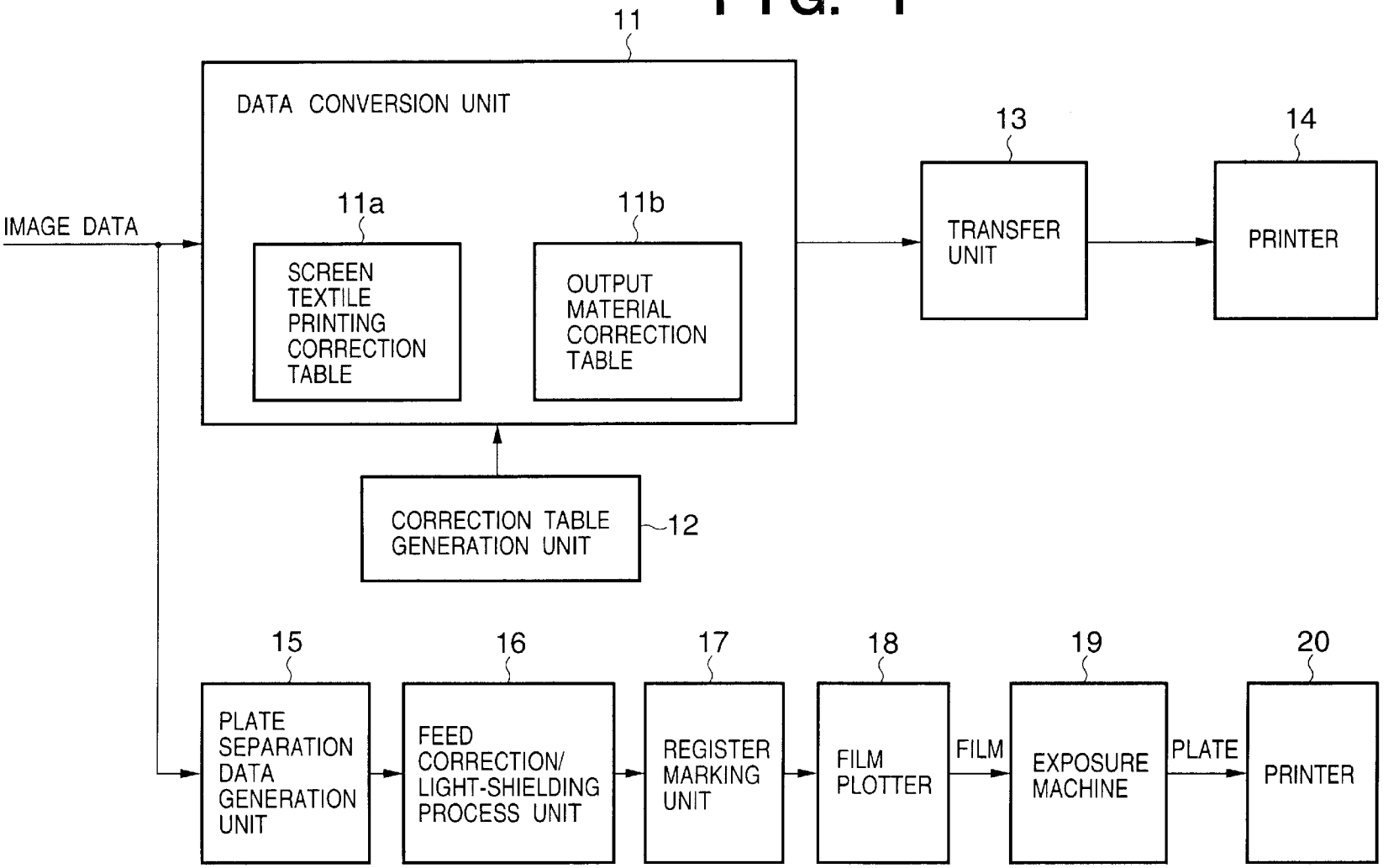
FIG. 1 is a block diagram showing the overall arrangement of a textile printing system according to an embodiment of the present invention.

FIG. 1 is a block diagram showing the overall arrangement of a system according to an embodiment of the present invention.

Image data that uses an RGB pallet is prepared with reference to the resolution of an ink-jet textile printer. Upon executing ink-jet textile printing, that image data is sent to a data conversion unit 11. The data conversion unit 11 converts the input image data from RGB image data into YMCK image data using a correction table generated by a correction table generation unit 12.

The converted image data is sent from a transfer unit 13 to an ink-jet textile printer 14. The ink-jet textile printer 14 prints on a textile on the basis of the image data.

The ink-jet textile printer 14 forms an image on textile using eight color inks, i.e., C (cyan), M (magenta), Y (yellow), K (black), B (blue), O (orange), LC (light cyan), and LM (light magenta) inks.

On the other hand, upon screen textile printing, image data that uses the RGB pallet is sent to a plate separation data generation unit 15, and is separated into binary plate data, the number of which is equal to the number of inks of the ink-jet textile printer, using a correction table corresponding to an output material and an RGB/ink color tone correction table that realizes the same tone expression as that of screen textile printing.

Plate (color) data are processed by a feed correction process/light-shielding process unit 16 in units of plate data, and are then provided with register marks by a register marking unit 17. A film plotter 18 prints image data in units of plates (colors) on lith films. The printed lith films are set in an exposure machine 19 and undergo exposure to obtain all plates. A screen textile printer 20 prints on a textile using the obtained plates. At this time, printing on the textile uses the same inks as those of the ink-jet textile printer.

[Correction Table Generation]

Figure 2:
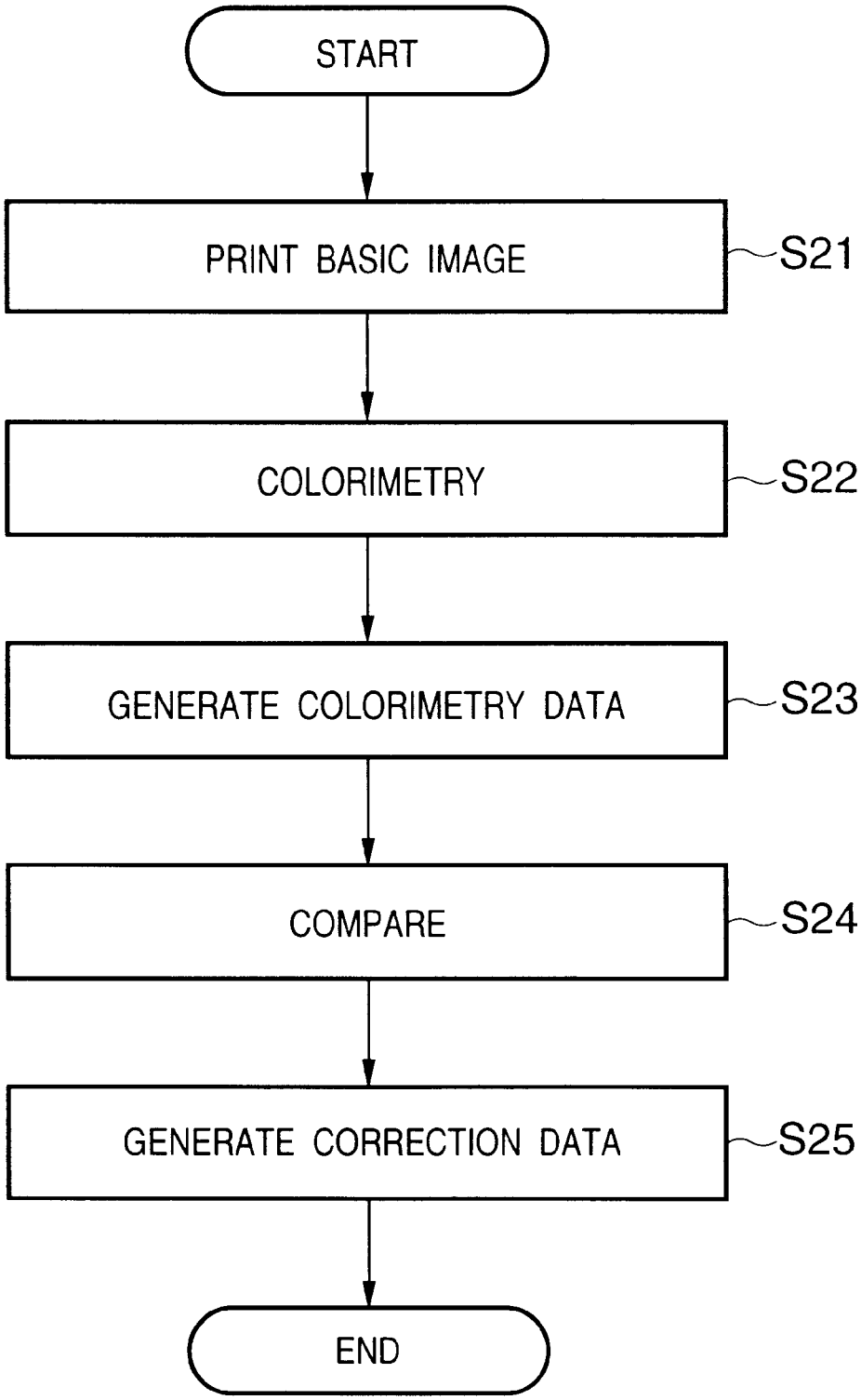
FIG. 2 is a flow chart for explaining a correction table generation process according to an embodiment of the present invention.

The process in the correction table generation unit 12 will be explained below with reference to FIG. 2.

The correction table generation unit 12 generates a correction table for adjusting the color reproduction characteristics of the ink-jet textile printer and screen textile printer.

In step S21, the ink-jet textile printer and screen textile printer output basic image (patch) data. The patches is data obtained by segmenting each of R, G, and B channels into nine steps. For this reason, the total number of patches is 729 (=9×9×9). The patches define nine blocks, each including 9×9 patches.

The patches output from these textile printers are measured in the order designated in units of blocks in step S22 to prepare colorimetry data in step S23. The individual colorimetry data are compared in step S24, and a correction table is generated in step S25.

Figure 3:
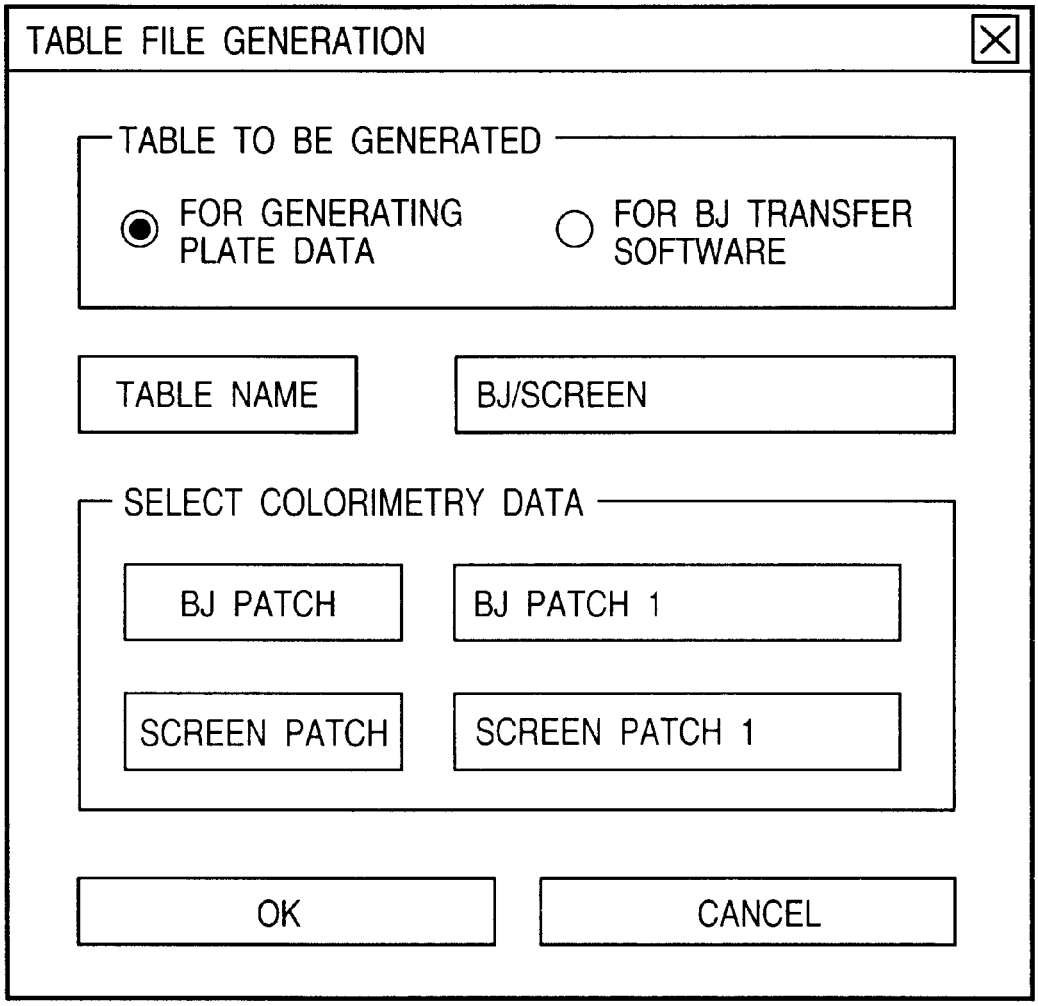
FIG. 3 shows a correction table generation dialog according to an embodiment of the present invention.

As the correction table, a correction table for the ink-jet or screen textile printer is generated on the basis of user's instruction on a correction target selector 31 on a dialog shown in FIG. 3.

When the user instructs to generate a correction table for the ink-jet textile printer, the correction table for the ink-jet textile printer is generated using color reproduction of the screen textile printer as a target in steps S24 and S25. The correction table for the ink-jet textile printer is effective when the color reproduction capability of the screen textile printer is inferior to that of the ink-jet textile printer.

The generated correction table for the ink-jet textile printer is set as a screen textile printing correction table 11*a* shown in FIG. 1.

On the other hand, when the user instructs to generate a correction table for the screen textile printer, the correction table for the screen textile printer is generated using color reproduction of the ink-jet textile printer as a target in steps S24 and S25. The correction table for the screen textile printer is effective when the color reproduction capability of the screen textile printer is equivalent to that of the ink-jet textile printer. When the correction table for the screen textile printer is generated, a correction table having linear conversion characteristics (not converted in practice) is set as the screen textile printing correction table 11*a*.

The generated correction table for the screen textile printer is set in step S104 in FIG. 10 (to be described later). That is, the plate separation data generation unit 15 shown in FIG. 1 separates image data that uses the RGB pallet into binary plate data, the number of which is equal to the number of inks of the ink-jet textile printer, using the correction table for the screen textile printer, an RGB/ink color tone table, and a correction table for an output material.

Note that the generated correction table is appended with information selected by a correction target selector 31, i.e., information indicating if this correction table is the one for the ink-jet or screen textile printer as header information.

The data conversion unit 11 shown in FIG. 1 converts an RGB pallet image into an ink pallet image using the screen textile printing correction table 11 generated in this way, and also performs data correction according to an output material using an output material correction table 11*b*.

[Plate Separation Data Generation]

The process executed in the plate separation generation unit 15 shown in FIG. 1 will be described below using FIGS. 4 to 12.

Figure 4:
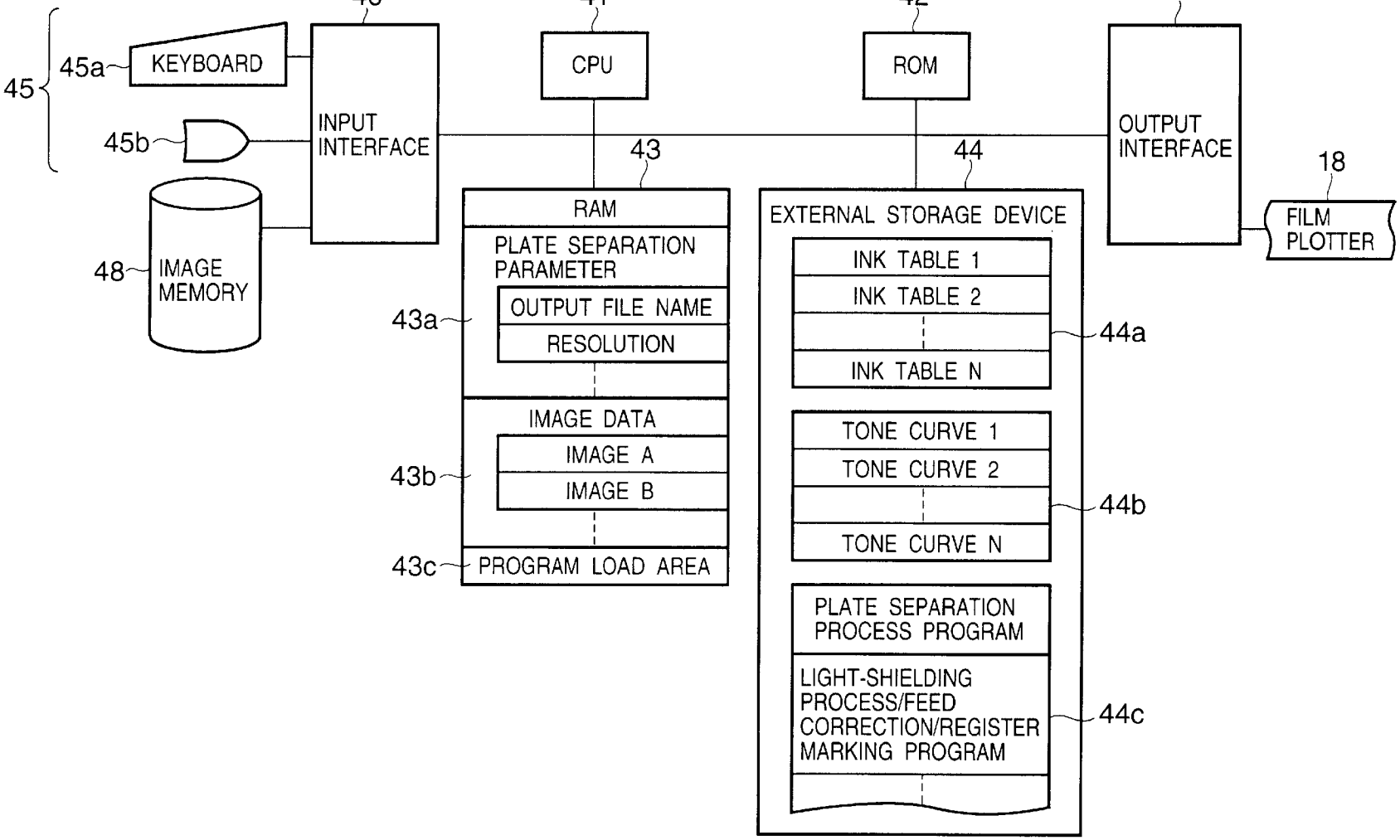
FIG. 4 is a block diagram showing the arrangement of a plate separation data generation unit according to an embodiment of the present invention.

FIG. 4 is a block diagram showing the hardware arrangement that implements a plate separation data generation process.

Reference numeral 41 denotes an arithmetic operation/control CPU for controlling the entire apparatus; 42, a ROM for storing a permanent program executed by the CPU 41, and parameters; and 43, a RAM for temporarily storing a program executed by the CPU 41 and parameters. In this embodiment, the RAM 43 comprises a plate separation parameter area 43*a* for storing items input and selected by the user, an image data area 43*b* for storing image data to be processed, and a program load area 43*c* for various programs executed by the CPU 41.

Reference numeral 44 denotes an external storage device such as a hard disk or the like. The external storage device 44 stores a plurality of ink tables 44*a*, tone curves 44*b*, and a plate separation process program 44*c*. Furthermore, as shown in FIG. 4, the external storage device 44 may store a program which implements a light-shielding/feed correction/register marking process. Also, the external storage device 44 may store an image. The program 44*c* is loaded onto the program load area 43*c* of the RAM 43, and is executed by the CPU 41.

Reference numeral 45 denotes an input device which includes a keyboard 45*a* and pointing device 45*b*; 46, an input interface for interfacing data from the input device 45; and 47, an output interface for interfacing output data to the film plotter 18. Reference numeral 48 denotes an image memory which stores image data scanned by a scanner or generated by another computer.

Figure 5:
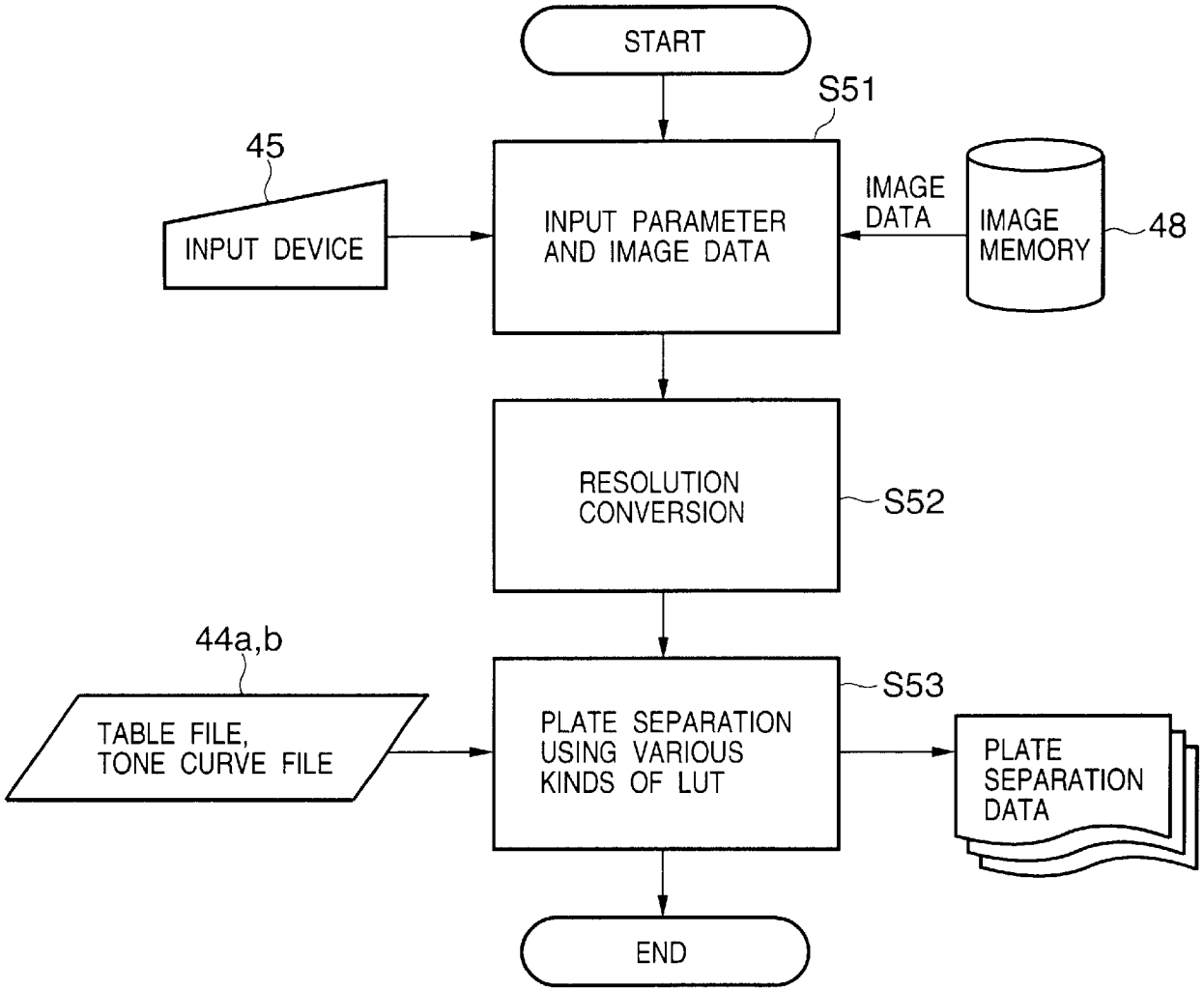
FIG. 5 is a flow chart for explaining an outline of a plate separation data generation process according to an embodiment of the present invention.

FIG. 5 is a flow chart for explaining an outline of the plate separation data generation process.

In step S51, various plate separation parameters are input from the input device 45, and image data is input from the image memory 48. The input parameters are stored in the RAM 43. In step S52, the image data undergoes resolution conversion on the basis of the input parameters. In step S53, the resolution-converted data undergoes a plate separation process using the ink tables 44*a*, tone curves 44*b*, and an output material table. In step S53, data conversion is done using a color correction table only when correction is made using the output from the ink-jet textile printer as a target.

Plate separation data are generated via these processes.

Figure 6:
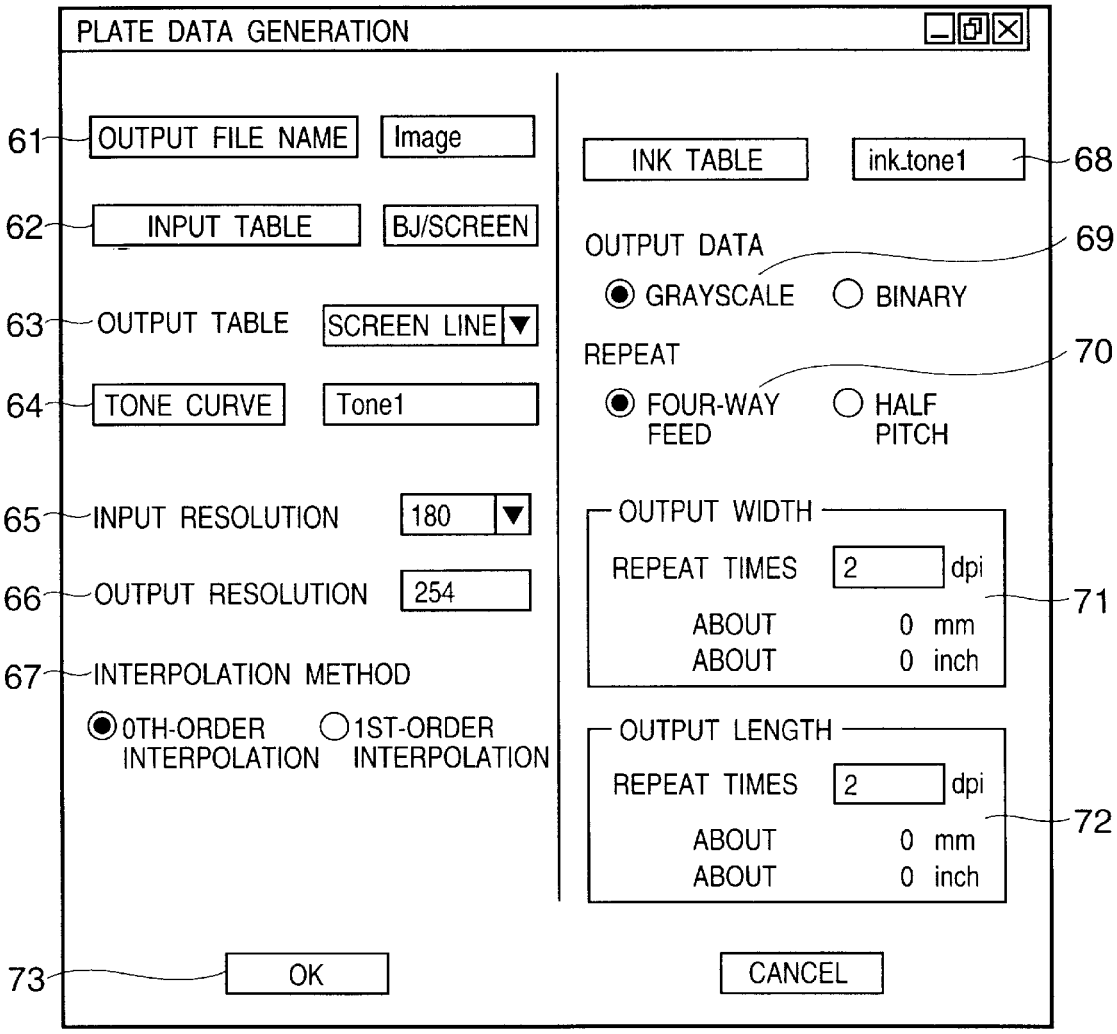
FIG. 6 shows a plate separation parameter setup dialog according to an embodiment of the present invention.

FIG. 6 shows an example of a dialog used to input plate separation parameters.

Referring to FIG. 6, a plate data file name to be generated, the resolution of a plate to be output, the number of repetitions of an original design of plate data to be output in the horizontal direction, and the number of repetitions of the original design of the plate data to be output in the vertical direction are respectively input to boxes 61, 66, 71, and 72. An input conversion file used to perform conversion according to the characteristics of an input device, an output conversion file used to perform conversion according to the characteristics of an output medium, a tone curve file used by retouch software, an original image resolution, an enlargement/reduction method, an ink table file, an output data type, and a repetition method are respectively selected using pull-down menus 62, 63, 64, 65, 67, 68, 69, and 70. Assume that image data to be processed has already been opened by image display or retouch software which can call this application before this application is launched.

Upon completion of the aforementioned inputs and selections, a button 73 is validated, loading of the input/selected files and interpretation of the designated methods are done, and plate data is saved using the file name designated in the box 61.

Figure 7:
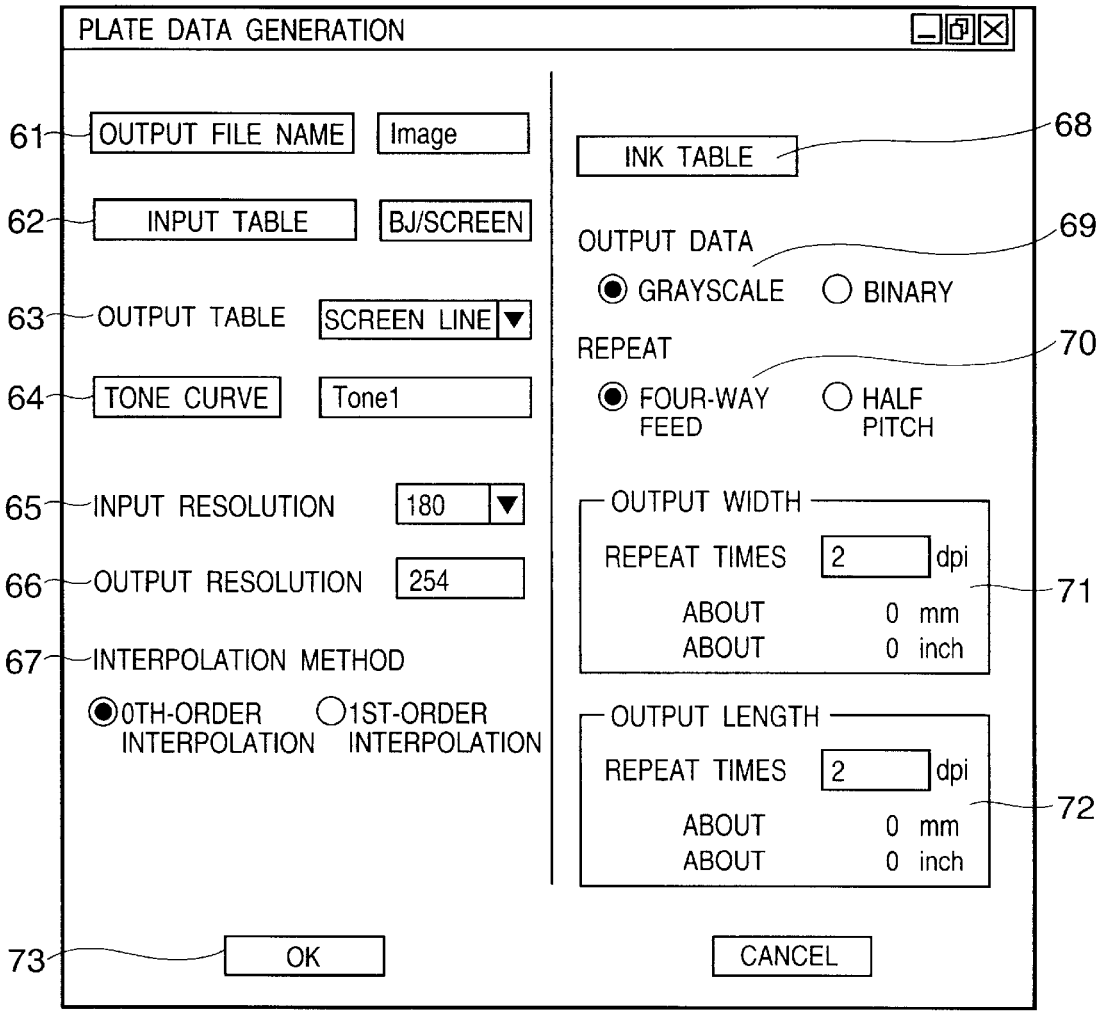
FIG. 7 shows a plate separation parameter setup dialog according to an embodiment of the present invention.

FIG. 7 shows another example of a dialog used to input plate separation parameters.

Figure 8:
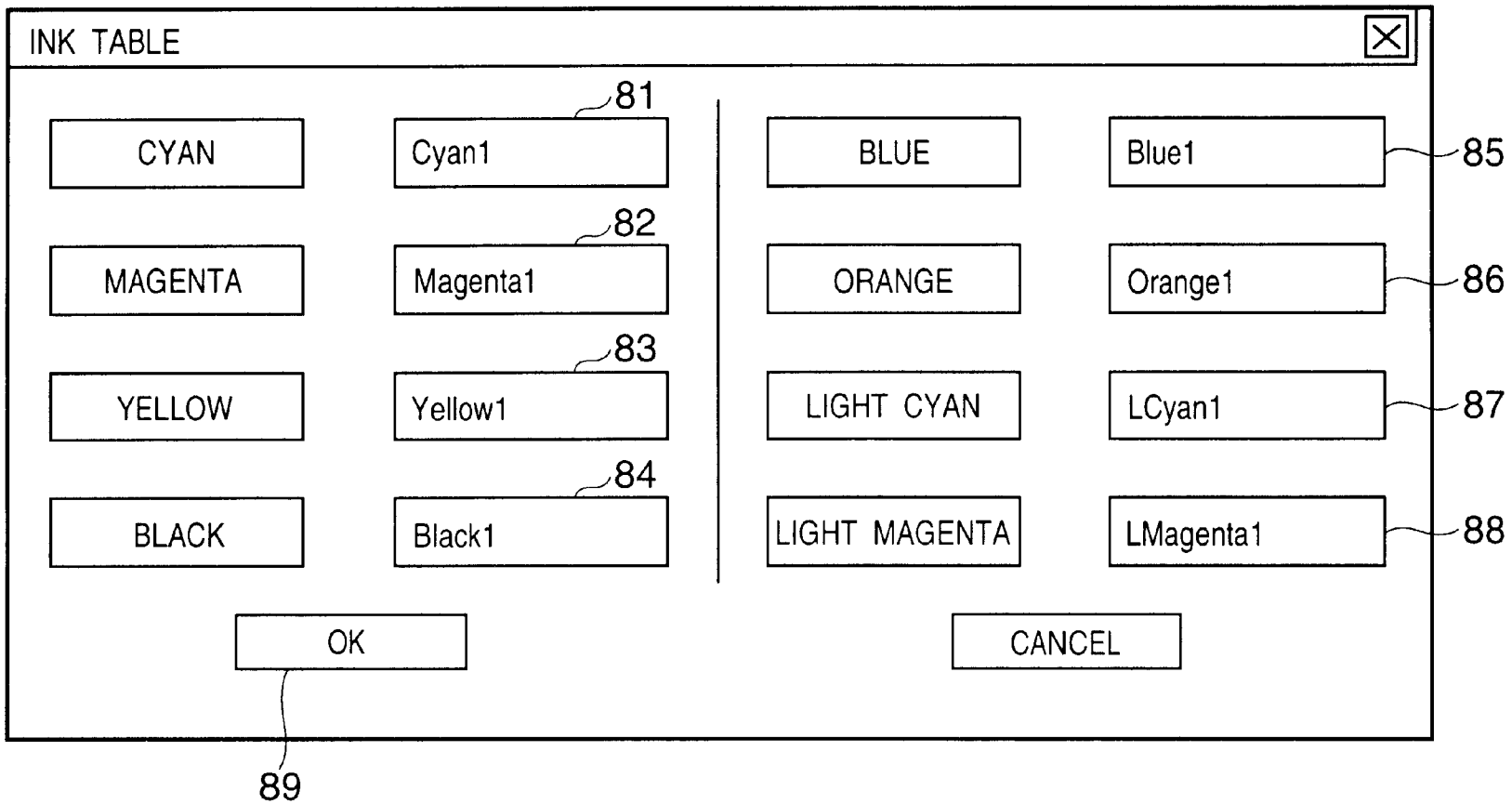
FIG. 8 shows an ink table setup dialog according to an embodiment of the present invention.

Unlike the dialog shown in FIG. 6, a menu call button used to select an ink table file replaces the pull-down menu 68. Upon depression of the button 68, a dialog in FIG. 8 is called. Referring to FIG. 8, tone curve files of individual inks are selected using boxes 81 to 88. Upon completion of this selection, a button 89 is validated, and the dialog shown in FIG. 7 is displayed again upon depression of the button 89.

Figure 9:
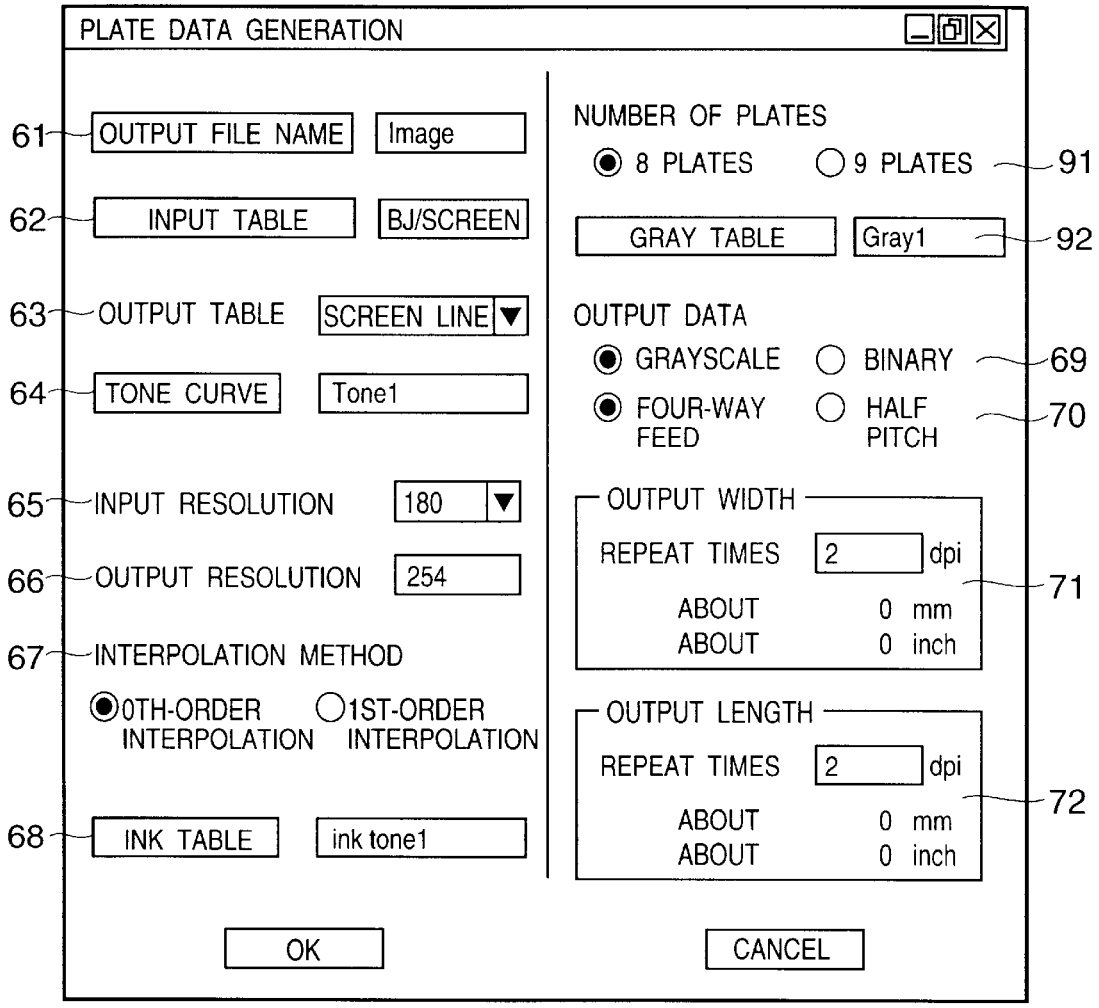
FIG. 9 shows a plate separation parameter setup dialog according to an embodiment of the present invention.

FIG. 9 shows still another example of a dialog used to input plate separation parameters.

Unlike the dialog shown in FIG. 6, eight plates or nine plates can be selected using switches 91, and a conversion file for gray plate generation can be selected using a box 92.

Figure 10:
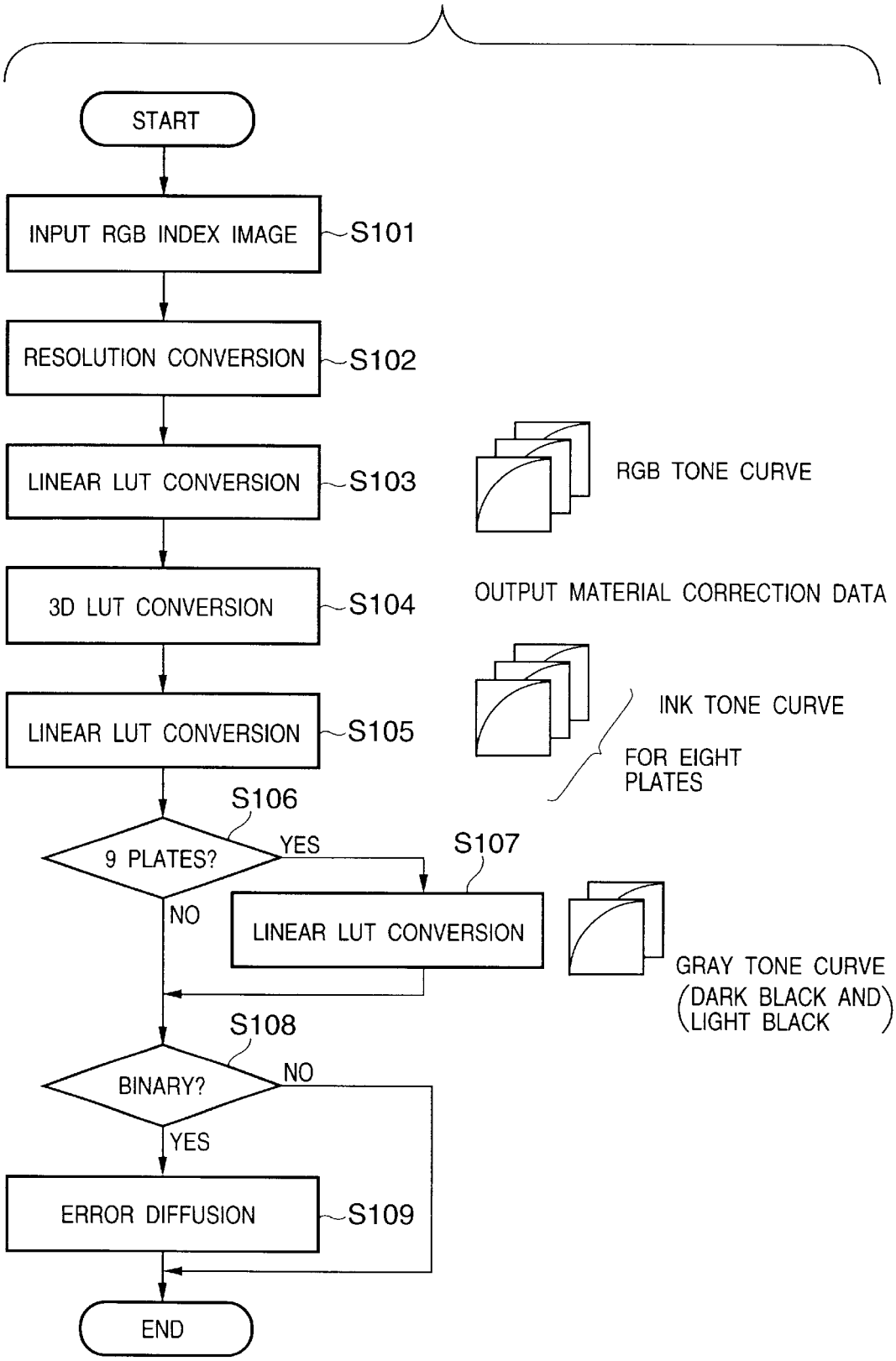
FIG. 10 is a flow chart for explaining details of the plate separation data generation process according to an embodiment of the present invention.

FIG. 10 is a flow chart for explaining details of the plate separation process. An RGB index image is input (S101), and undergoes resolution conversion (S102). This resolution conversion process is done in correspondence with the resolution of the screen textile printing film plotter. An index pallet undergoes linear LUT conversion using an RGB tone file (S103), and is converted into ink color pallets using correction data that matches an output material (S104). The converted ink color pallets undergo linear LUT conversion using ink tone curve data (S105) to generate eight or nine plate data. If it is determined in step S106 that nine plate data are generated, a black plate is separated into dark and light black plates using gray tone curve data (S107). If it is determined in step S108 that a binary format of an image to be generated is designated, the respective plate data undergo error diffusion (S109) to generate binary data.

If the color reproduction capability of the ink-jet textile printer is equivalent to that of the screen textile printer, image data input to the plate separation data generation unit 15 is corrected to match the color expression in ink-jet textile printing. That is, RGB data which has been converted in step S103 using the correction table (using the ink-jet printer as a target) for the screen textile printer generated in the flow chart shown in FIG. 2 is converted into ink color data. Whether or not this process is done can be determined by confirming the header information of the correction table generated by the correction table generation unit.

In this embodiment, the number of plates used in screen textile printing and the number of colors formed by the plates are limited on the basis of eight colors used in the ink-jet textile printer 14. When nine plates are used, since black is separated into two, dark and light black plates, black is reproduced using two plates in ink-jet textile printing.

In this manner, since the number of plates used in screen textile printing and the number of colors formed by the plates are determined in correspondence with the ink-jet textile printer, high-precision color matching can be realized. In this embodiment, in order to realize higher-precision color matching, the order in which plates are formed is determined in correspondence with the order of colors formed by the ink-jet textile printer.

Figure 11:
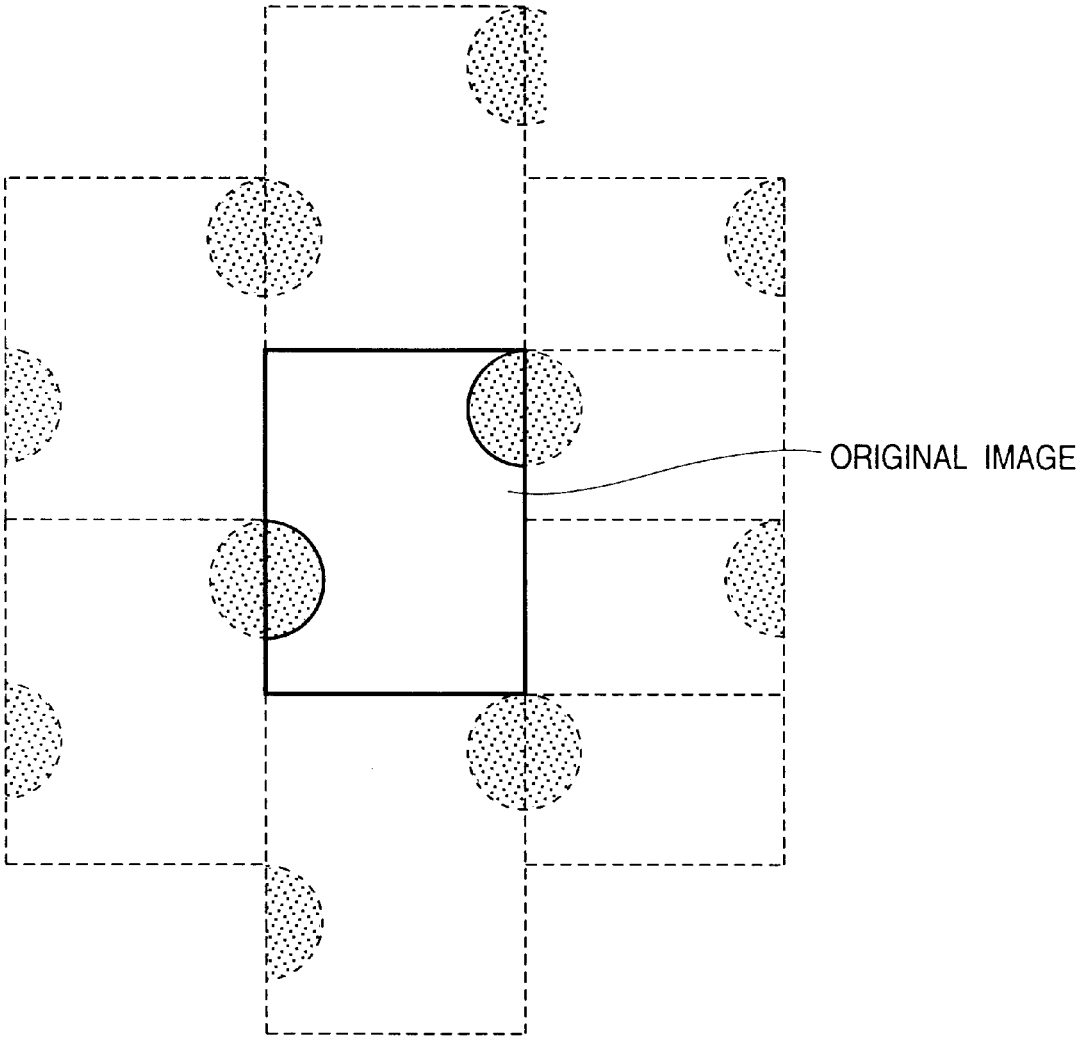
FIG. 11 is a view for explaining half-step plate separation.
Figure 12:
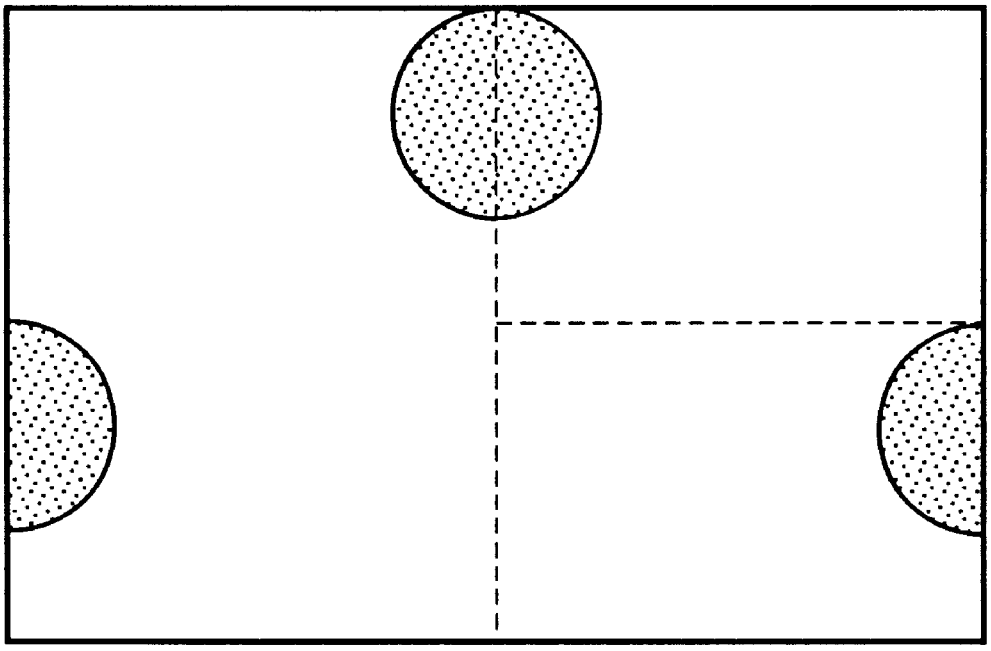
FIG. 12 is a view for explaining half-step plate separation.

The size of an image to be generated can be designated by repeating an original image an arbitrary number of times in the horizontal and vertical directions. Furthermore, when the original image is a half-step image, as shown in FIG. 11, half-step plates are generated, as shown in FIG. 12.

As described above, according to this embodiment, a patch test is conducted in advance to generate a correction table which corrects to obtain equivalent color expressions in screen textile printing and ink-jet textile printing. After that, a print process is done by adjusting the number of colors of screen textile printing to that of ink-jet textile printing. Therefore, screen textile printing and ink-jet textile printing can realize equivalent color expressions. Hence, a sample generated by ink-jet textile printing can be effectively used.

Furthermore, since plate separation parameters can be input and selected using a single dialog, plate separation data can be easily generated.

As a result, a plateless textile printer that uses process color expression and a plate textile printer can realize equivalent color expressions.

(Another Embodiment)

In the above embodiment, processes from generation of plate separation data for screen textile printing through a print process have been explained. However, the present invention is not limited to such specific processes. For example, the present invention can be applied to rotary textile printing, hand textile printing, roll textile printing, and the like, as long as an apparatus prints on a textile using spot color expression.

Note that the present invention may be applied to either a system constituted by a plurality of devices (e.g., a host computer, an interface device, a reader, a printer, and the like), or an apparatus consisting of a single device (e.g., a copying machine, a facsimile apparatus, or the like).

The objects of the present invention are also achieved by supplying a storage medium, which records a program code of a software program that can implement the functions of the above-mentioned embodiments to the system or apparatus, and reading out and executing the program code stored in the storage medium by a computer (or a CPU or MPU) of the system or apparatus. In this case, the program code itself read out from the storage medium implements the functions of the above-mentioned embodiments, and the storage medium which stores the program code constitutes the present invention. The functions of the above-mentioned embodiments may be implemented not only by executing the readout program code by the computer but also by some or all of actual processing operations executed by an OS (operating system) running on the computer on the basis of an instruction of the program code.

Furthermore, the functions of the above-mentioned embodiments may be implemented by some or all of actual processing operations executed by a CPU or the like arranged in a function extension board or a function extension unit, which is inserted in or connected to the computer, after the program code read out from the storage medium is written in a memory of the extension board or unit.

As many apparently widely different embodiments of the present invention can be made without departing from the spirit and scope thereof, it is to be understood that the invention is not limited to the specific embodiments thereof except as defined in the appended claims.

What s claimed is:

1. A textile printing system comprising:

a first textile printer that makes process color expression;

plate separation means for performing a plate separation process for original image data, and outputting plate data; and a second textile printer for performing textile printing using plates based on the plate data, wherein said plate separation means comprises:

input means for inputting a file name and resolution of plate data to be output, and a number of repetitions of original image data; and selection means for selecting a conversion table file, a tone curve file, a resolution of original image data, a conversion ink table file, a resolution conversion method, the number of plate data, and a type of repetition of the original image data, wherein said plate separation means performs plate separation on the basis of the inputs from said input means and the selections at said selection means.

2. The system according to claim 1, wherein said selection means selects the conversion ink table file for each ink color.

3. The system according to claim 1, wherein the number of ink colors of said first textile printer is eight, and the number of plates of said second textile printer is eight.

4. The system according to claim 1, wherein said plate separation means separates the image data into plates, the number of which is larger by one than the number of ink colors of said first textile printer.

5. The system according to claim 4, wherein a gray plate is generated in addition to plates corresponding to ink colors.

6. The system according to claim 1, wherein said second textile printer is a printer which uses one of a hand textile printer scheme, screen textile printer scheme, roll textile printer scheme, and rotary textile printer scheme.

7. A textile printing system comprising:

a first textile printer which makes process color expression without using any plates;

plate separation means for performing a plate separation process for original image data, and outputting plate data; and a second textile printer for performing textile printing using plates based on the plate data, wherein said plate separation means comprises:

input means for inputting a type of repetition of the original image data and a number of times of repetition; and plate data generation means for generating plate data from the original image data on the basis of the inputs from said input means.

8. The system according to claim 7, wherein said input means can select one of four-way feed and half pitch as the type of repetition.

9. A plate separation apparatus which receives image data which is the same as image data input to a first textile printer that makes process color expression without using any plates, generates plate data corresponding to ink colors used in the first textile printer, and outputs the plate data to a second textile printer that performs textile printing using plates, comprising:

input means for inputting a type of repetition of original image data and the number of times of repetition; and plate data generation means for generating plate data from the original image data on the basis of the inputs from said input means.

10. A plate separation method which receives image data which is the same as image data input to a first textile printer that makes process color expression without using any plates, generates plate data corresponding to ink colors used in the first textile printer, and outputs the plate data to a second textile printer that performs textile printing using plates, comprising:

an input step of inputting a type of repetition of original image data and a number of times of repetition; and a plate data generation step of generating plate data from the original image data on the basis of the inputs in the input step.

11. A computer readable memory storing a plate separation program, which receives image data which is the same as image data input to a first textile printer that makes process color expression without using any plates, generates plate data corresponding to ink colors used in the first textile printer, and outputs the plate data to a second textile printer that performs textile printing using plates, said plate separation program including:

an input program for inputting a type of repetition of original image data and a number of times of repetition; and a plate data generation program for generating plate data from the original image data on the basis of the inputs in the input program.

12. A textile printing system comprising:

a first textile printer that makes process color expression;

plate separation means for performing a plate separation process for separating original image data into plate data, the number of which is equal to the number of inks used in said first textile printer; and a second textile printer for performing textile printing using plates generated based on plate data output from said plate separation means, wherein said first and second textile printers print using identical inks.

13. The system according to claim 12, further comprising correction table generation means for measuring colors of basic images printed by said first and second textile printers, and generating a correction table which is used to correct original image data input to one of said first and second textile printers to achieve equivalent color expressions.

14. The system according to claim 12, further comprising resolution conversion means for converting image data having a resolution corresponding to said first textile printer into image data having a resolution corresponding to said second textile printer.

15. The system according to claim 14, further comprising selection means for selection one of 0th-order interpolation and 1st-order interpolation as a resolution conversion method.

16. The system according to claim 12, wherein said plate separation means has color conversion means for performing a correction process using an RGB tone table and ink tone table.

17. The system according to claim 12, wherein said plate separation means has selection means for selecting one of grayscale data and binary data as the plate data.

18. The system according to claim 12, wherein said plate separation means has selection means for selecting one of four-way feed and half-pitch feed upon generating the plate data.

19. The system according to claim 12, wherein said plate separation means has input means for setting a size of the plate data.

20. The system according to claim 12, further comprising feed correction/light-shielding process means for performing a feed correction/light-shielding process of the plate data.

21. The system according to claim 12, further comprising register marking means for adding register marks to the plate data.

22. The system according to claim 12, wherein said second textile printer is a printer which uses one of a hand textile printing scheme, screen textile printing scheme, roll textile printing scheme, and rotary textile printing scheme.

23. The system according to claim 12, wherein said first textile printer is an ink-jet textile printer.

24. A method of controlling a textile printing system having a first textile printer that makes process color expression, and a second textile printer for performing textile printing using plates, said method comprising:

a plate separation step of performing a plate separation process for separating image data into plate data, the number of which is equal to the number of inks used in the first textile printer; and a print step of printing using identical inks in the first and second textile printers.

25. A computer readable memory storing a control program for a textile printing system having a first textile printer that makes process color expression, and a second textile printer for performing textile printing using plates, said control program comprising:

a plate separation program for performing a plate separation process for separating image data into plate data, the number of which is equal to the number of inks used in the first textile printer.

* * * * *

UNITED STATES PATENT AND TRADEMARK OFFICE

CERTIFICATE OF CORRECTION

PATENT NO. : 6,765,690 B1
DATED : July 20, 2004
INVENTOR(S) : Hisashi Matsumoto et al.

It is certified that error appears in the above-identified patent and that said Letters Patent is hereby corrected as shown below:

Title page,
Item [57], ABSTRACT, should read

--A textile printing system includes a first textile printer that makes process color expression, plate separation means for performing a plate separation process for original image data and outputting plate data, and a second textile printer for printing using plates based on the plate data. The plate separation means includes input means and selection means. The input means inputs a file name and resolution of plate data to be output and a number of repetitions of original image data. The selection means selects a conversion table file, a tone curve file, a resolution of original image data, a conversion ink table file, a resolution conversion method, the number of plate data, and a type of repetition of the original image data. The plate separation means performs plate separation on the basis of the inputs from the input means and the selections at the selection means.--

Column 4,
Lines 29 and 59, "textile" should read -- a textile --.

Column 5,
Line 20, "patches is" should read -- patches are --.

Column 8,
Line 61, "What s" should read -- What is --.

Column 10,
Line 43, "selection" (second occurrence) should read -- selecting --.

Signed and Sealed this

Eighteenth Day of January, 2005

JON W. DUDAS
*Director of the United States Patent and Trademark Office*